US010403078B2

(12) United States Patent
Choi

(10) Patent No.: US 10,403,078 B2
(45) Date of Patent: Sep. 3, 2019

(54) MEDIUM PROCESSING APPARATUS AND METHOD THEREOF

(71) Applicant: ATEC AP CO., LTD., Seongnam-si, Gyeonggi-do (KR)

(72) Inventor: Min Kyu Choi, Seoul (KR)

(73) Assignee: ATEC AP CO., LTD., Seongnam-si, Gyeonggi-Do (KR)

( * ) Notice: Subject to any disclaimer, the term of this patent is extended or adjusted under 35 U.S.C. 154(b) by 0 days.

(21) Appl. No.: 15/809,564

(22) Filed: Nov. 10, 2017

(65) Prior Publication Data

US 2018/0240294 A1 Aug. 23, 2018

(30) Foreign Application Priority Data

Dec. 1, 2016 (KR) ..... 10-2016-0162949

(51) Int. Cl.

| | |
|---|---|
| ***G07D 11/12*** | (2019.01) |
| ***G07D 11/16*** | (2019.01) |
| ***B65H 83/02*** | (2006.01) |
| ***G07D 11/50*** | (2019.01) |
| ***G07D 11/24*** | (2019.01) |

(52) U.S. Cl.

CPC ..... *G07D 11/50* (2019.01); *B65H 83/02* (2013.01); *G07D 11/12* (2019.01); *G07D 11/16* (2019.01); *G07D 11/24* (2019.01); *B65H 2701/1912* (2013.01)

(58) Field of Classification Search

CPC ..... G07D 11/0084; G07D 11/0006; G07D 11/0021; G07D 11/0054

USPC ..... 209/534, 552

See application file for complete search history.

(56) References Cited

U.S. PATENT DOCUMENTS

| | | | | |
|---|---|---|---|---|
| 4,747,492 | A * | 5/1988 | Saito | G07D 11/50 209/534 |
| 5,105,364 | A * | 4/1992 | Kawamura | G07D 11/34 700/219 |
| 8,240,450 | B2 * | 8/2012 | Brexel | G07D 11/25 194/206 |
| 2002/0198839 | A1 | 12/2002 | Uozumi et al. | |
| 2008/0060906 | A1 * | 3/2008 | Fitzgerald | G07D 11/40 194/207 |

(Continued)

FOREIGN PATENT DOCUMENTS

| | | |
|---|---|---|
| JP | 2003006697 A | 1/2003 |
| JP | 2013011959 A | 1/2013 |

(Continued)

*Primary Examiner* — Terrell H Matthews

(74) *Attorney, Agent, or Firm* — Dentons US LLP

(57) ABSTRACT

Disclosed herein is an apparatus for processing a medium, including: a accepting unit in which the medium is loaded; a dispending unit from which the medium is withdrawn; a medium discriminator configured to discriminate a denomination of the medium loaded into the accepting unit; a plurality of medium storage boxes configured to each discriminate and store the medium by denomination of the medium discriminated by the medium discriminator; and a controller configured to store the medium loaded through the accepting unit by the same denomination in the medium storage box and withdraw the loaded medium from the medium storage box according to a predetermined withdrawal criterion.

22 Claims, 12 Drawing Sheets

(56) References Cited

U.S. PATENT DOCUMENTS

| | | | | |
|---|---|---|---|---|
| 2009/0166269 | A1* | 7/2009 | Tanaka | G07D 11/50 209/534 |
| 2009/0183967 | A1 | 7/2009 | Hamasaki | |
| 2010/0025911 | A1 | 2/2010 | Sakamoto | |
| 2010/0181333 | A1 | 7/2010 | Mizushima | |
| 2013/0006414 | A1 | 1/2013 | Tagashira et al. | |
| 2014/0144750 | A1 | 5/2014 | Shimizu et al. | |
| 2014/0291110 | A1* | 10/2014 | Adachi | G07D 11/50 194/206 |

FOREIGN PATENT DOCUMENTS

| | | | |
|---|---|---|---|
| JP | 2013205908 | A | 10/2013 |
| KR | 1020130078396 | A | 7/2013 |
| WO | 2008056404 | A1 | 5/2008 |
| WO | 2013084645 | A1 | 6/2013 |
| WO | 2013145600 | A1 | 10/2013 |

* cited by examiner

MEDIUM PROCESSING APPARATUS AND METHOD THEREOF

CROSS-REFERENCE TO RELATED APPLICATION

This application is based on and claims the benefit of priority to Korean Patent Application No. 10-2016-0162949 filed on 1 Dec. 2016 in the Korean Intellectual Property Office, the disclosure of which is incorporated herein in its entirety by reference.

TECHNICAL FIELD

The present disclosure relates to an apparatus and a method for processing a medium. More specifically, the present disclosure relates to an apparatus and a method for separating and counting media for each denomination.

BACKGROUND

By virtue of financial apparatuses, user may use financial services provided by banks or credit card companies without the help of members of a financial institution. To this end, the financial apparatus provides users with financial services such as deposit, account transfer, balance inquiry, deposit withdrawal, and account book update, and also prints details of financial services on paper and provides the paper to a user.

However, it is generally difficult for the financial apparatus to efficiently process media for various denominations. The financial apparatus is generally limited in size. Due to the size limitation, the number of medium storage boxes for storing media within the financial apparatus is also limited.

Therefore, there may be a great difference in processing capability of financial apparatus depending on how to store media for various denominations in the medium storage box and how to withdraw the media from the medium storage box. Since recent financial apparatus have to process media for a wide variety of denominations from various countries, the above problems are becoming more and more serious.

Specifically, in large-capacity medium batch processing, the related art does not have a function of separating denominations of media separately, and therefore, when it is desired to sort randomly arranged banknotes (cf. bill), the related art can check the number and the amount by denomination, but has the inconvenience that the processed banknotes need to be arranged by hand again. Further, the related art has a problem in that when a user wants to process a large amount of banknotes, he/she has to manually remove media every 300 sheets and repeatedly contact apparatuses since the number of filtered and withdrawn media has to be removed at 50 sheets or less.

SUMMARY

The present disclosure has been made to solve the above-mentioned problems occurring in the prior art while advantages achieved by the prior art are maintained intact.

An aspect of the present disclosure provides user convenience by processing media for each denomination in processing a large-capacity medium.

According to an exemplary embodiment of the present disclosure, an apparatus for processing a medium includes: a accepting unit in which the medium is loaded; a dispending unit from which the medium is withdrawn; a medium discriminator configured to discriminate a denomination of the medium loaded into the accepting unit; a plurality of medium storage boxes configured to each discriminate and store the medium by denomination of the medium discriminated by the medium discriminator; and a controller configured to store the medium loaded through the accepting unit by the same denomination in the medium storage box and withdraw the loaded medium from the medium storage box according to a predetermined withdrawal criterion.

According to another exemplary embodiment of the present disclosure, a method for processing a medium includes: discriminating denominations of a plurality of deposited media; transferring the medium of which the denomination is discriminated to a medium storage box in which the same denomination is stored among a plurality of medium storage units; and withdrawing the medium stored in the medium storage box to a dispending unit according to a predetermined withdrawal criterion.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
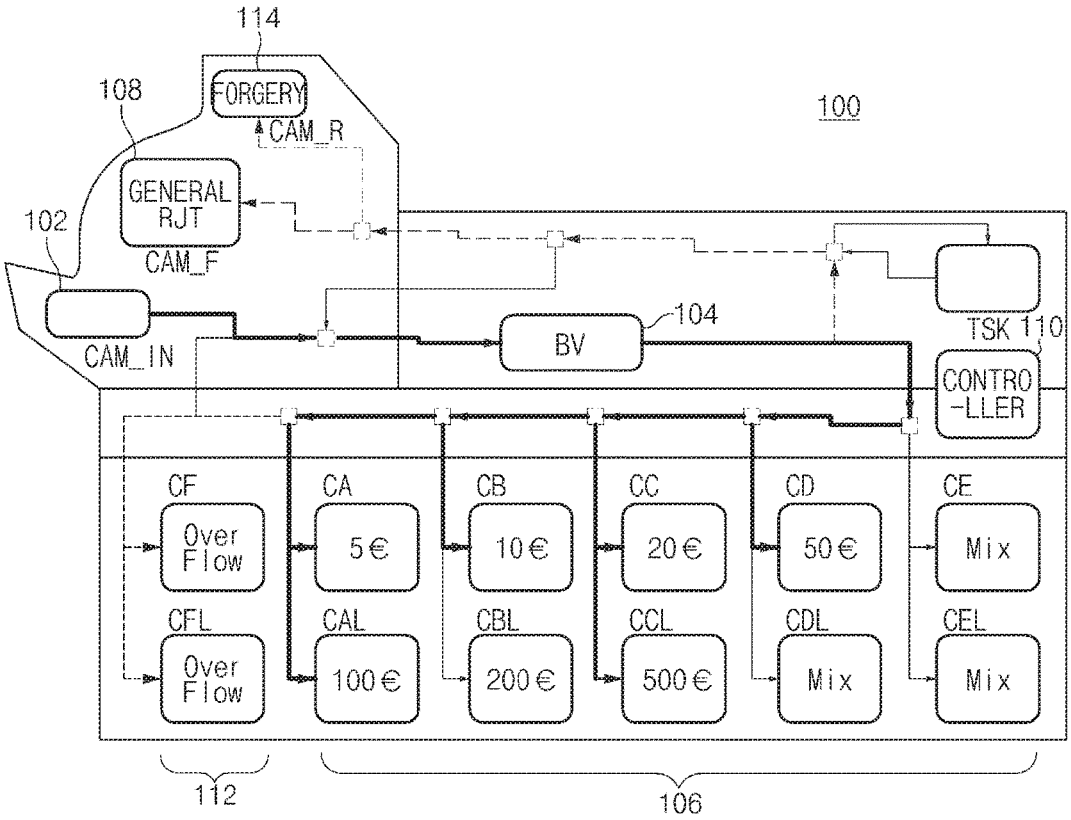
FIG. 1 is a diagram showing a configuration of an apparatus 100 for processing a medium according to the present disclosure.

Hereinafter, exemplary embodiments of the present disclosure will be described with reference to the accompanying drawings. It is to be noted that in giving reference numerals to components of each of the accompanying drawings, the same components will be denoted by the same reference numerals even though they are shown in different drawings. Further, in describing exemplary embodiments of the present disclosure, well-known constructions or functions will not be described in detail in the case in which it is decided that they may unnecessarily obscure the understanding of the present disclosure.

In addition, in describing components of exemplary embodiments of the present disclosure, terms such as first, second, A, B, (a), (b), etc. can be used. These terms are used only to differentiate the components from other components. Therefore, the nature, times, sequence, etc. of the corresponding components are not limited by these terms. When any components are "connected", "coupled", or "linked" to other components, it is to be noted that the components may be directly connected or linked to other components, but the components may be "connected", "coupled", or "linked" to other components via another component therebetween.

FIG. 1 is a diagram showing a configuration of an apparatus 100 for processing a medium according to the present disclosure. The apparatus 100 for processing a medium according to the present disclosure includes a accepting unit 102, a medium discriminator 104, a medium storage unit 106, a dispending unit 108, a controller 110, an operating cassette 112, and a reject unit 114.

A user may put a medium through the accepting unit 102.

The medium discriminator 104 may discriminate a type, state, denomination, etc. of media.

The medium storage unit 106 may include a plurality of medium storage boxes 106*a*, 106*b*, and 106*c*. At least one of the plurality of medium storage boxes may store banknotes, and one or more of the plurality of medium storage boxes may store checks. Alternatively, all of the plurality of medium storage boxes may store banknotes or checks. The media may be separated and stored by denomination, and may be stored in different medium storage boxes according to the denomination of the media discriminated by the medium discriminator 104. A single denomination medium is stored in a single storage box, and media for a plurality of denominations may be stored in a single medium storage box.

The apparatus may further include an operating cassette (OP cassette 112). The operating cassette may be used for various purposes. For example, when the medium storage unit 106, in which a medium for the same denomination as the corresponding medium is stored, is in a full state, the apparatus for processing a medium may further include the operating cassette as a separate cassette in which the medium for the same denomination as the corresponding medium may be stored. However, if even the operating cassette 112 is in a full state, the deposit medium for the corresponding denomination is transferred to the dispending unit 108 again.

The controller 110 loads a plurality of media deposited through the accepting unit 102 into the medium storage unit 106 by the same denomination, and withdraws media stored in the respective medium storage units 106 according to predetermined criteria. The predetermined withdrawal criteria may consider, for example, storing media from the closest medium storage box, storing media from a medium storage box in which the number of stored media is small, or storing media according to a kind of states for the corresponding media.

The deposited medium is withdrawn from the dispending unit 108 through a predetermined process.

Meanwhile, a process of discriminating, by the medium discriminator 104, whether the medium deposited through the accepting unit 102 is a normal medium or an abnormal medium may be additionally performed. The medium discriminator 104 discriminates the medium to be normal/abnormal based on specific criteria, and the general abnormal medium is an abnormal medium excluding a fake banknote, a suspicious banknote of the fake banknote, and a damaged banknote. Further, the medium discriminator 104 may additionally perform discriminating the medium discriminated to be abnormal as a general abnormal medium and a forgery medium, a forgeable medium or a damaged medium. A medium discriminated to be normal by the medium discriminator 104 is transferred to and stored in the medium storage unit 106 by denomination, and a detailed method thereof will be described below. In addition, the medium discriminated to be a general normal medium by the medium discriminator 104 may be transferred to the dispending unit 108 and the medium discriminated as a forgery medium, a forgeable medium, or a damaged medium is transferred to the rejecter 114. Further, the medium discriminated to be normal by the medium discriminator 104 may be additionally subjected to an additional discrimination of a denomination. In addition, the medium discriminator 106 may directly discriminate a denomination of a medium without performing the discrimination on whether the deposited medium is normal or abnormal.

In addition, a storage unit (not shown) stores a serial number of a medium recognized for all deposited media and also stores the number of all denominations.

Withdrawing, by the dispending unit 108, the medium to be discriminated as a general abnormal medium by the medium discriminator 104 or withdrawing, by the dispending unit 108, the media discriminated to be normal by the medium discriminator 104 and stored in the medium storage unit 106 for each denomination may be additionally performed.

The rejecter 114 is a cassette for storing a medium discriminated as a forgery medium, a forgeable medium, or a damaged medium by the medium discriminator 104, which is an additional component. In some cases, the rejecter may also be omitted.

In addition, when the number of medium storage units 106 is plural, for example, the medium may be stored from the closest medium storage box, or the medium may be stored from the medium storage box in which the number of stored media is small, or the medium may be stored according to a type of states for the corresponding medium. This will be described below. In addition, the storage of the medium in the medium storage unit 106 can be made when the medium storage box is not in a full state, and each medium storage box is set to be deposit only or reflux among deposit only/withdrawal only/reflux.

When the medium storage unit 106, in which a medium for the same denomination as the corresponding medium is stored, is in a full state, the apparatus for processing a medium may further include the operating cassette 112 as a separate cassette in which the medium for the same denomination as the corresponding medium may be stored. However, if even the operating cassette 112 is in a full state, the deposit medium for the corresponding denomination is transferred to the dispending unit 108 again.

The controller 110 may additionally perform a function of transferring the general abnormal medium among the media discriminated to be abnormal by the medium discriminator 104 to the dispending unit 108, the medium discriminated as the forgery medium, the forgeable medium, or the damaged medium to the rejecter 114, and the normal medium of which the denomination is discriminated to the medium storage unit 105. In addition, the medium discriminator 104 discriminates the denomination to transfer the corresponding medium to the cassette in which each denomination is stored by the same denomination. In addition, when the corresponding medium is transferred to the cassette in which each denomination is stored, if the number of medium storage boxes in which the same denomination is stored is plural, the controller 110 may store a medium, for example, in the order of the closest medium storage box or in the order of the smallest number of media. In addition, when the loaded medium stored in the medium storage box 106 is withdrawn, the controller 110 may perform an additional function of withdrawing the corresponding loaded medium according to the predetermined withdrawal criteria. The withdrawn medium is the loaded medium, and when the withdrawn medium is stored and then all the media is loaded, the media may be continuously withdrawn according to the predetermined condition. The medium may be withdrawn according to the predetermined withdrawal criteria. For example, the medium is withdrawn in the order of the medium storage box in which the medium having fewer denominations among the loaded media is stored, in the order of the smallest total amount of media stored in the medium storage box, in the order of the largest total amount of media stored in the medium storage box, in the order of the largest denomination amount of the media stored in the medium storage box, or in the order of the smallest amount of denominations of the media stored in the medium storage box.

In addition, when media loaded to process a medium are withdrawn, if a larger number of media than the loaded media are withdrawn, the controller 110 may additionally perform a function of comparing serial numbers of all the media deposited-returning by a bundle process to again transfer a medium just next to a medium in which the last medium of the deposited media is discovered to a medium storage unit or comparing serial numbers of last 5 to 10 sheets deposited-returning by a bundle process to again transfer a medium just next to a medium in which the last deposited medium of the deposited media is discovered to the medium storage unit. In addition, when media loaded to process a medium are withdrawn, if the media less than the number of loaded media are withdrawn, the controller 110 compares the serial numbers of all media or the serial numbers of the last 5 to 10 sheets to additionally perform the function of performing an additional pickup.

Figure 2:
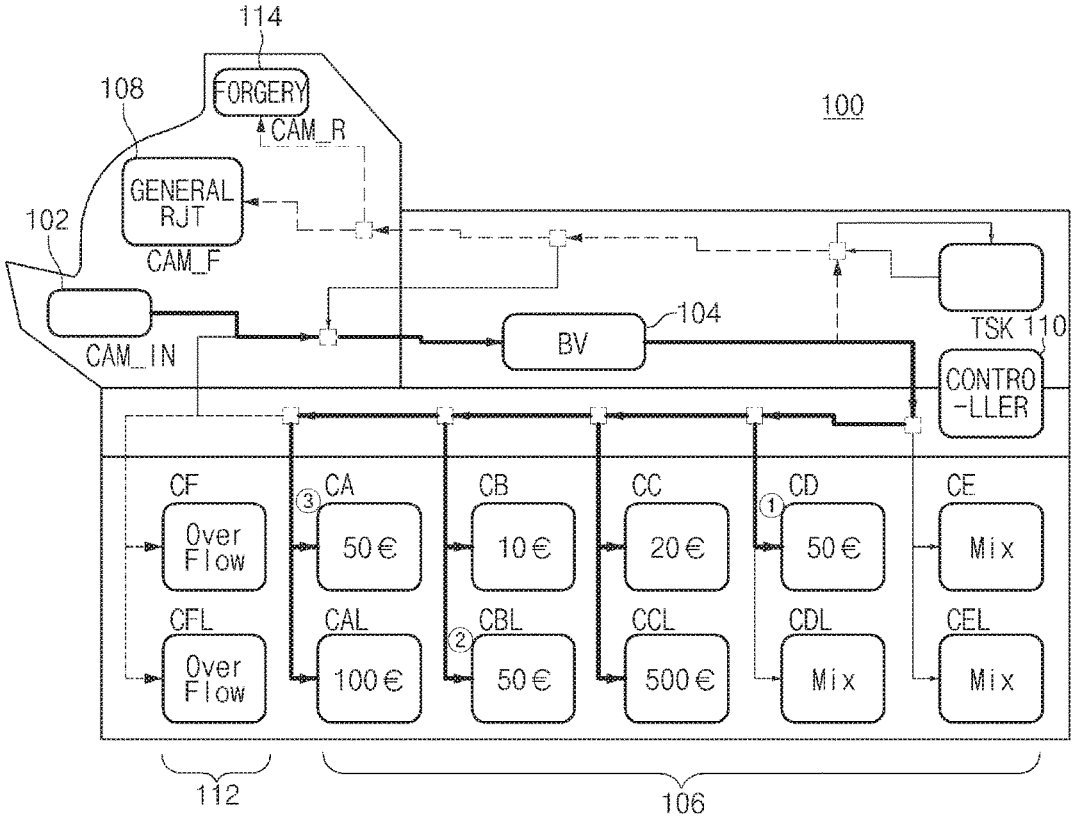
FIG. 2 is a view illustrating a sequence in which deposited media are stored in medium storage boxes for each denomination, according to an exemplary embodiment of the present disclosure.

FIG. 2 is a view illustrating a sequence in which deposited media are stored in medium storage boxes, according to an exemplary embodiment of the present disclosure. The apparatus for processing a medium shown in FIG. 2 has the same configuration as the apparatus for processing a medium shown in FIG. 1.

The order that the deposited media shown in FIG. 2 are stored in the cassettes is that, for example, when there are a plurality of medium storage units 106 storing the same denomination, as short-length of the a transfer distance of the media, the media is stored from the medium storage box. Specifically, the medium discriminator 104 discriminates whether the medium deposited in the accepting unit 102 is normal or abnormal. After the medium discriminator 104 again discriminates whether the medium discriminated to be abnormal is the general abnormal medium or the forgery medium, the forgeable medium, or the damaged medium, the medium discriminated as the general abnormal medium is transferred to the dispending unit 108 and the medium discriminated as the forgery medium, the forgeable medium, or the damaged medium is transferred to the rejecter 114. The medium discriminated to be normal by the medium discriminator 104 is transferred to the medium storage unit 106 after the denomination of the corresponding medium is discriminated. For example, when the medium discriminated to be normal is for 50 euros medium and the number of medium storage boxes capable of storing 50 euros medium is plural (ca, cd, cbl), the medium is stored from the medium storage box cd having the short medium transfer distance from the medium discriminator 104. If the medium storage box cd is in a full state before all of the media are stored, the remaining media are stored in the medium storage box ca having a short transfer distance of a medium, and if the medium storage box ca is in a full state, the media are stored in the medium storage box cbl. If all of the medium storage boxes for each denomination in which 50 euros may be stored are full, 50 euros may also be stored in the operating cassette 112. In addition, if all of the medium storage boxes in which 50 euros may be stored are full, the media are transferred to the dispending unit 108.

Figure 3:
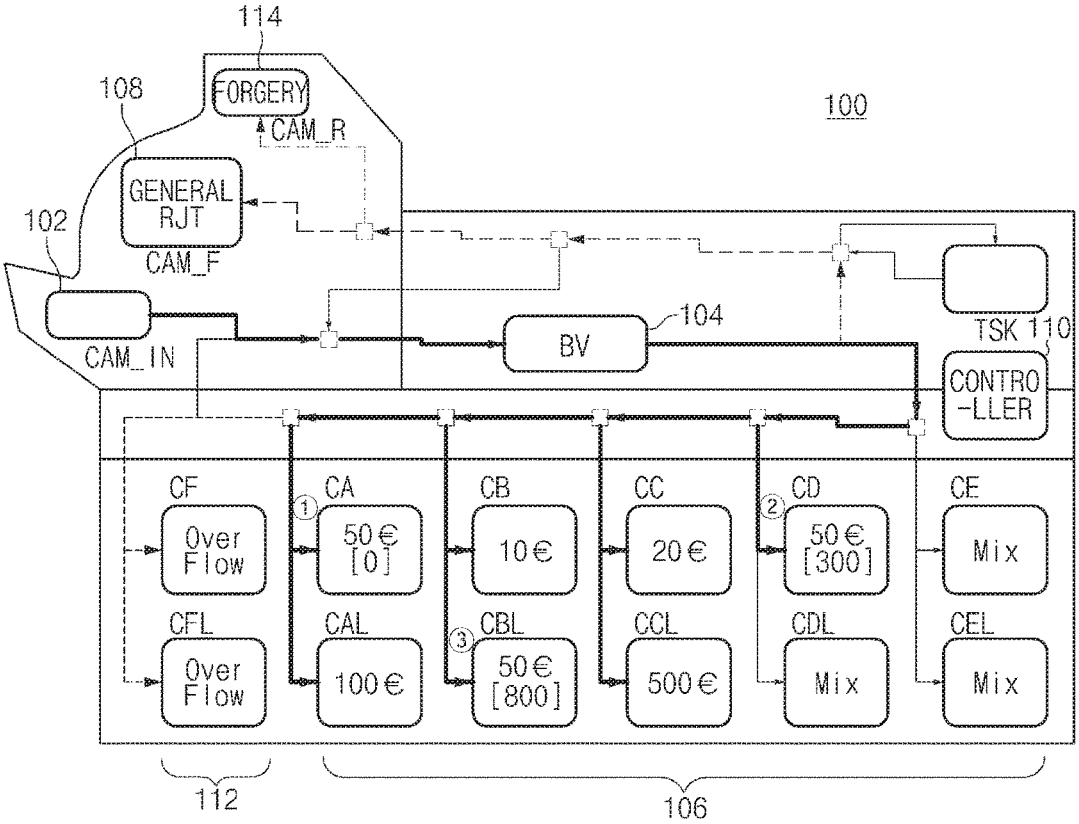
FIG. 3 is a view illustrating a sequence in which deposited media are stored in medium storage boxes for each denomination, according to another exemplary embodiment of the present disclosure.

The order that the deposited media shown in FIG. 3 are stored in the cassette is that, for example, when there are the plurality of medium storage units 106 storing the same denomination, the media are stored in the medium storage box in the order of the smallest number of stored media. Specifically, the medium discriminator 104 discriminates whether the medium deposited in the accepting unit 102 is normal or abnormal. After the medium discriminator 104 again discriminates whether the medium discriminated to be abnormal is the general abnormal medium or the forgery medium, the forgeable medium, or the damaged medium, the medium discriminated as the general abnormal medium is transferred to the dispending unit 108 and the medium discriminated as the forgery medium, the forgeable medium, or the damaged medium is transferred to the rejecter 114. The medium discriminated to be normal by the medium discriminator 104 is transferred to the medium storage unit 106 after the denomination of the corresponding medium is discriminated. For example, when the medium discriminated to be normal is for 50 euros and the number of medium storage boxes capable of storing 50 euros is plural (ca, cd, cbl), a 50-euro medium is stored from the medium storage box having the smallest number of stored 50-euro media. That is, since the number of sheets of 50 euros stored in each medium storage box is 0 in the medium storage box ca, 300 in the medium storage box cd, and 800 in the medium storage box cbl, the medium of 50 euros discriminated to be normal by the medium discriminator 104 is stored in the order of the medium storage box ca, the medium storage box cd, and the medium storage box cbl in the order of the cassette having the small number of stored media. If all of the cassettes for each denomination in which 50 euros may be stored are full, 50 euros may also be stored in the operating cassette 112. In addition, if all of the medium storage boxes in which 50 euros may be stored are full, the media are transferred to the dispending unit 108.

Figure 4:
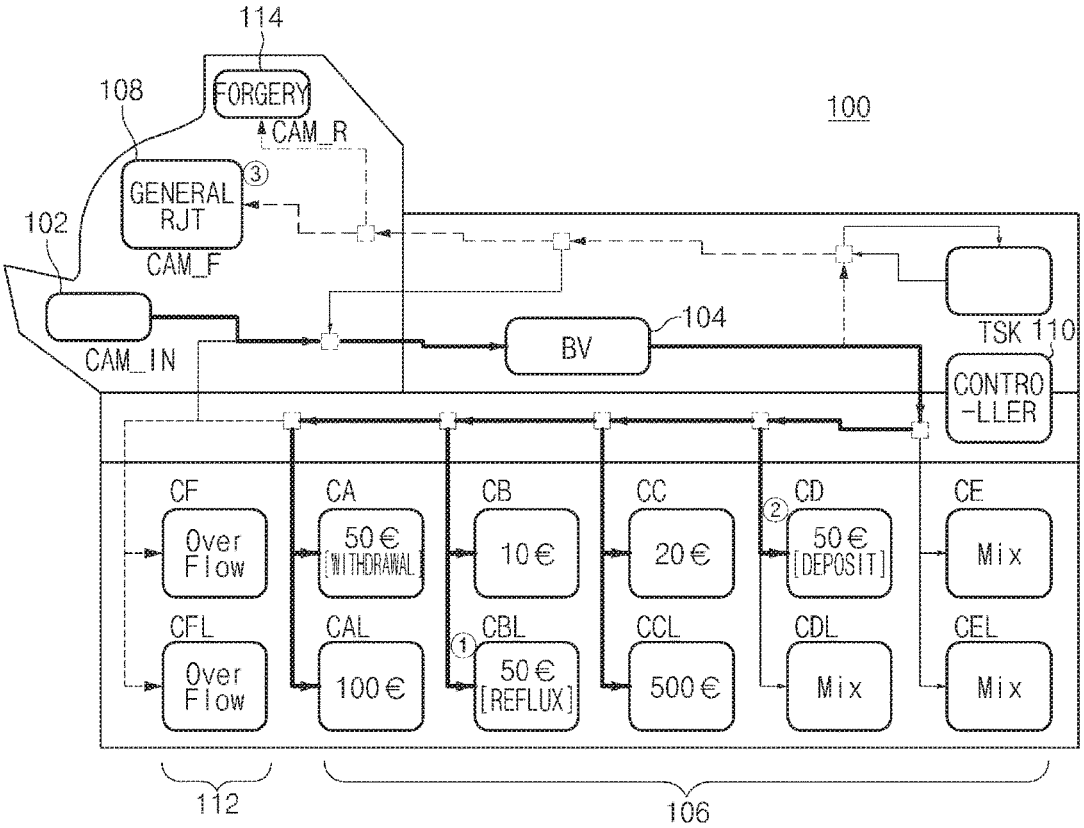
FIG. 4 is a view illustrating a sequence in which deposited media are stored in medium storage boxes for each denomination, according to still another exemplary embodiment of the present disclosure.

FIG. 4 shows a case where the deposited media are stored according to the type of the medium storage boxes. Specifically, the medium discriminator 104 discriminates whether the medium deposited in the accepting unit 102 is normal or abnormal. After the medium discriminator 104 again discriminates whether the medium discriminated to be abnormal is the general abnormal medium or the forgery medium, the forgeable medium, or the damaged medium, the medium discriminated as the general abnormal medium is transferred to the dispending unit 108 and the medium discriminated as the forgery medium, the forgeable medium, or the damaged medium is transferred to the rejecter 114. The medium discriminated to be normal by the medium discriminator 104 is transferred to the medium storage unit 106 after the denomination of the corresponding medium is discriminated. For example, since the medium discriminated to be normal is 50 euros, there are a plurality of medium storage boxes cd and cbl capable of storing 50 euros, the medium storage box cd is a deposit-only medium storage box, and the medium storage box cbl is a reflux medium storage box, 50 euros are stored in the medium storage box cd when only the deposit is performed and stored in the medium storage box cbl when only the reflux is performed, according to the storage type of the deposited 50 euros.

FIGS. 5 to 11 show exemplary embodiments in which the stored media are withdrawn from the medium storage unit 106 or the operating cassette 112.

Figure 5:
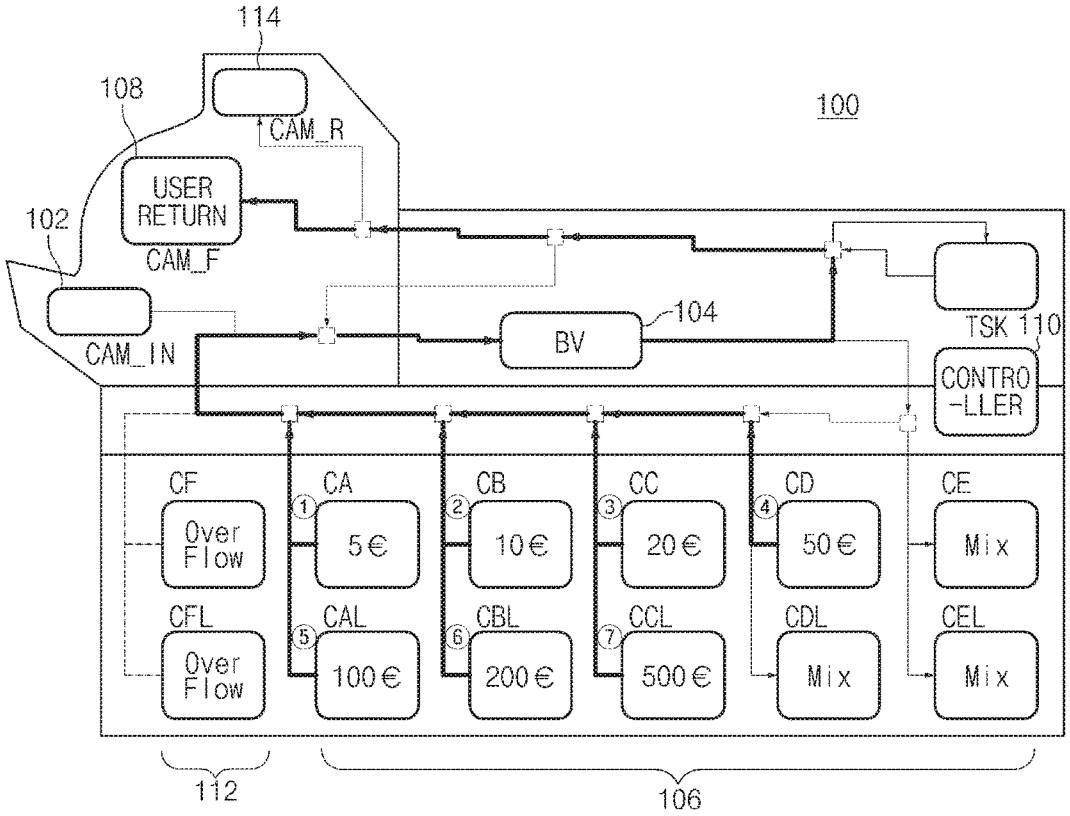
FIG. 5 is a diagram showing an exemplary embodiment in which a medium stored in a low-denomination bill medium storage box is withdrawn first.

FIG. 5 is a diagram showing an exemplary embodiment in which a medium stored in a low-denomination bill medium storage box is withdrawn first. Specifically, the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the medium storage box cd, a 100-euro medium is stored in the medium storage box cal, a 200-euro medium is stored in the medium storage box cbl, and a 500-euro medium is stored in the medium storage box ccl. For the medium storage box in which only the same denomination is stored, when the medium stored in the corresponding medium storage box is withdrawn, according to the present exemplary embodiment, the medium stored in the medium storage box in which a low-denomination bill is stored is withdrawn first. That is, referring to FIG. 5, the media stored in each medium storage box are withdrawn to the dispending unit 108 in order from a medium storage box in which a lowest denomination bill, 5 euros are stored to a medium storage box in which a highest-denomination bill, 500 euros are stored, that is, in the order of Nos. 1 to 7.

Also, if a larger number of media are withdrawn when the media are withdrawn, the serial numbers of all media deposited-withdrawn by the bundle process are compared to be able to again transfer a medium just next to a medium in which the last deposited medium is discovered to the cassettes for each denomination or the serial numbers of the last 5 to 10 sheets deposited-returning by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 6:
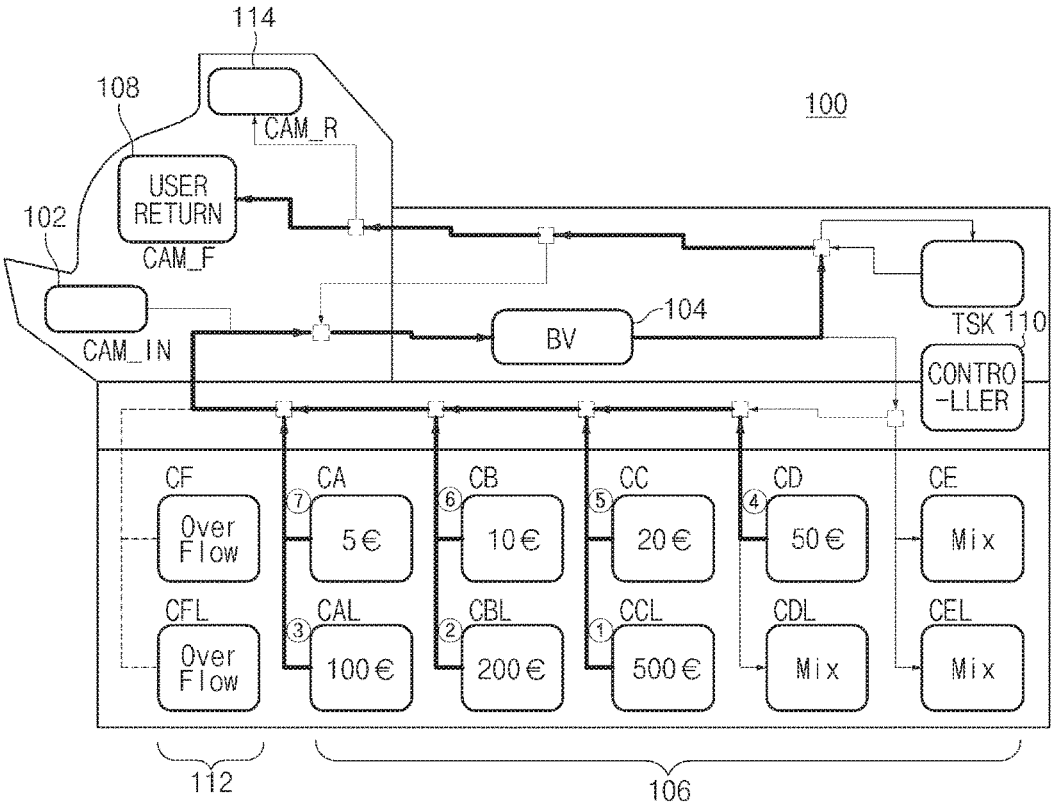
FIG. 6 is a diagram showing an exemplary embodiment in which a medium stored in a high-denomination bill medium storage box is withdrawn first.

FIG. 6 is a diagram showing an exemplary embodiment in which a medium stored in a high-denomination bill cassette returns first. Specifically, the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the medium storage box cd, a 100-euro medium is stored in the medium storage box cal, a 200-euro medium is stored in the medium storage box cbl, and a 500-euro medium is stored in the medium storage box ccl. For the medium storage box in which only the same denomination is stored, when the medium stored in the corresponding medium storage box is withdrawn, according to the present exemplary embodiment, the medium stored in the medium storage box in which a high-denomination bill is stored is withdrawn first. That is, referring to FIG. 6, the media stored in each medium storage box are withdrawn to the dispending unit 108 in order from a medium storage box in which a highest-denomination bill, 500 euros are stored to a medium storage box in which a lowest denomination bill, 5 euros are stored, that is, in the order of Nos. 1 to 7.

Also, if a larger number of media are withdrawn when the media are withdrawn, the serial numbers of all media deposited-returning by the bundle process are compared to be able to again transfer a medium just next to a medium in which the last deposited medium is discovered to the medium storage boxes for each denomination or the serial numbers of the last 5 to 10 sheets deposited-returning by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 7:
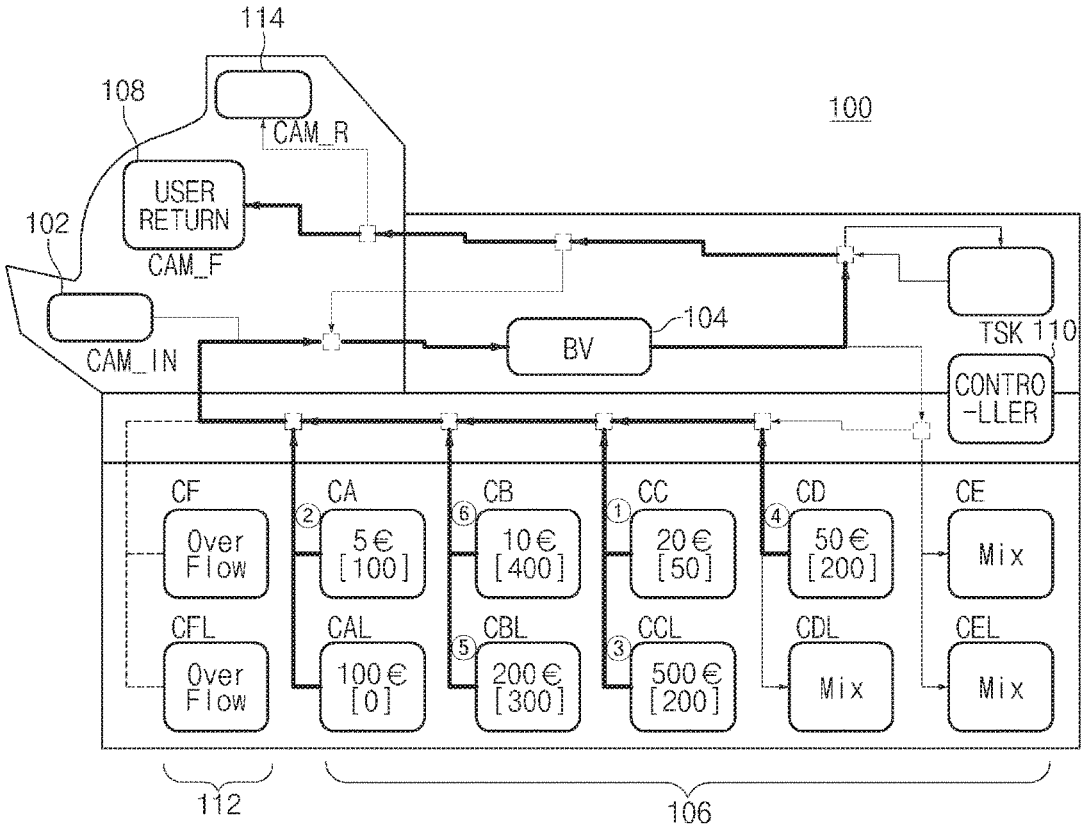
FIG. 7 is a diagram showing an exemplary embodiment in which media are withdrawn in the order of a medium storage box in which the number of media stored in the medium storage box is small.

FIG. 7 is a diagram showing an exemplary embodiment in which media are withdrawn in the order of a medium storage box in which the number of media stored in the medium storage box is small. Specifically. the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the medium storage box cd, a 100-euro medium is stored in the medium storage box cal, a 200-euro medium is stored in the medium storage box cbl, and a 500-euro medium is stored in the medium storage box ccl. In addition, according to the present exemplary embodiment, 100 sheets of 5 euros, 400 sheets of 10 euros, 50 sheets of 20 euros, 200 sheets of 50 euros, 0 sheets of 100 euros, 300 sheets of 200 euros, and 200 sheets of 500 euros are stored in each of the medium storage boxes. For the medium storage box in which only the same denomination is stored, when the medium stored in the corresponding medium storage box is withdrawn, according to the present exemplary embodiment, the medium is withdrawn in the order of the smallest number of media stored in each of the medium storage box. That is, referring to FIG. 7, the medium is withdrawn in order of the medium storage box in which the smallest number of stored media is stored, that is, in the order of ① 20 euros, ② 5 euros, ③ 500 euros, ④ 50 euros, ⑤ 200 euros, and ⑥ 10 euros in which the number of stored media.

Also, if a larger number of media are withdrawn when the media are withdrawn, the serial numbers of all media deposited-withdrawn by the bundle process are compared to be able to again transfer a medium just next to a medium in which the last deposited medium is discovered to the medium storage boxes for each denomination or the serial numbers of the last 5 to 10 sheets deposited-returning by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 8:
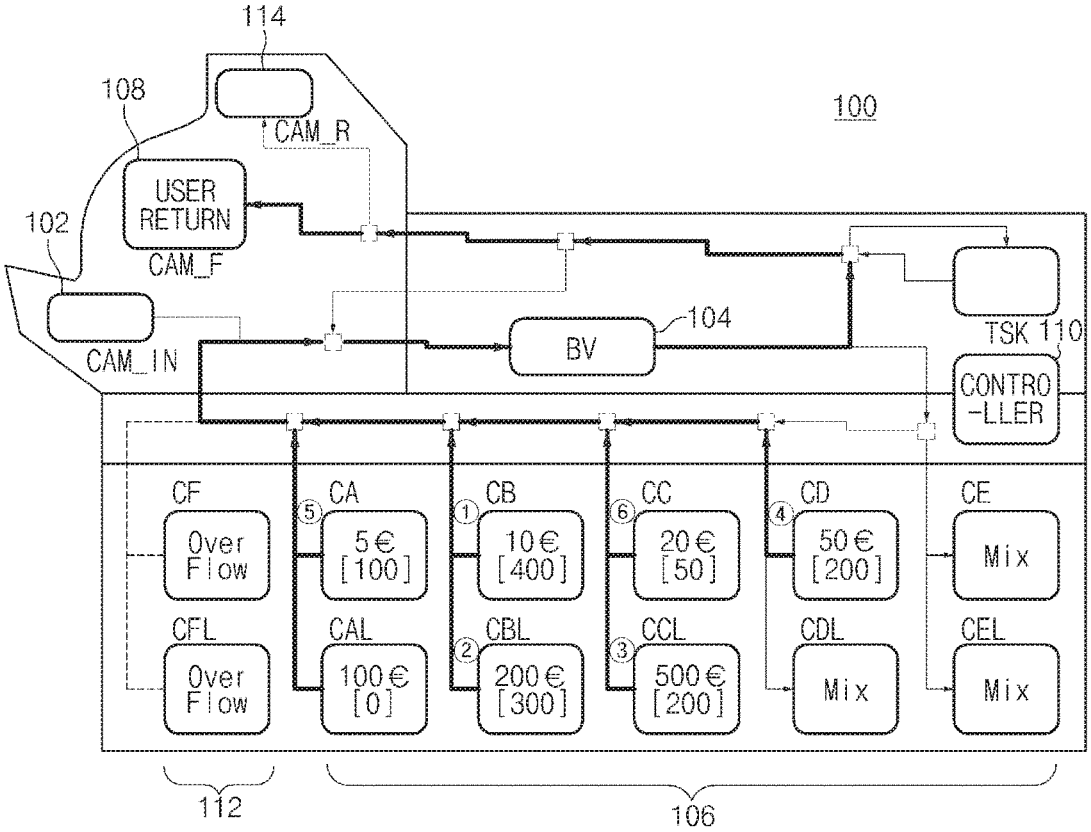
FIG. 8 is a diagram showing an exemplary embodiment in which media are withdrawn in the order of a medium storage box in which the number of media stored in the medium storage box is large.

FIG. 8 is a diagram showing an exemplary embodiment in which media are withdrawn in the order of a medium storage box in which the number of media stored in the medium storage box is large. Specifically. the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the medium storage box cd, a 100-euro medium is stored in the medium storage box cal, a 200-euro medium is stored in the medium storage box cbl, and a 500-euro medium is stored in the medium storage box ccl. In addition, according to the present exemplary embodiment, 100 sheets of 5 euros, 400 sheets of 10 euros, 50 sheets of 20 euros, 200 sheets of 50 euros, 0 sheets of 100 euros, 300 sheets of 200 euros, and 200 sheets of 500 euros are stored in each of the medium storage boxes. For the medium storage box in which only the same denomination is stored, when the medium stored in the corresponding medium storage box is withdrawn, according to the present exemplary embodiment, the medium is withdrawn in the order of the largest number of media stored in each of the medium storage box. That is, referring to FIG. 8, the medium is withdrawn in the order of the largest number of stored media, that is, in the order of ① 10 euros, ② 200 euros, ③ 500 euros, ④ 50 euros, ⑤ euros, and ⑥ 20 euros.

Also, if a larger number of media are withdrawn when the media are withdrawn, the serial numbers of all media deposited-returning by the bundle process are compared to be able to again transfer a medium just next to a medium in which the last deposited medium is discovered to the medium storage boxes for each denomination or the serial numbers of the last 5 to 10 sheets deposited-returning by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 9:
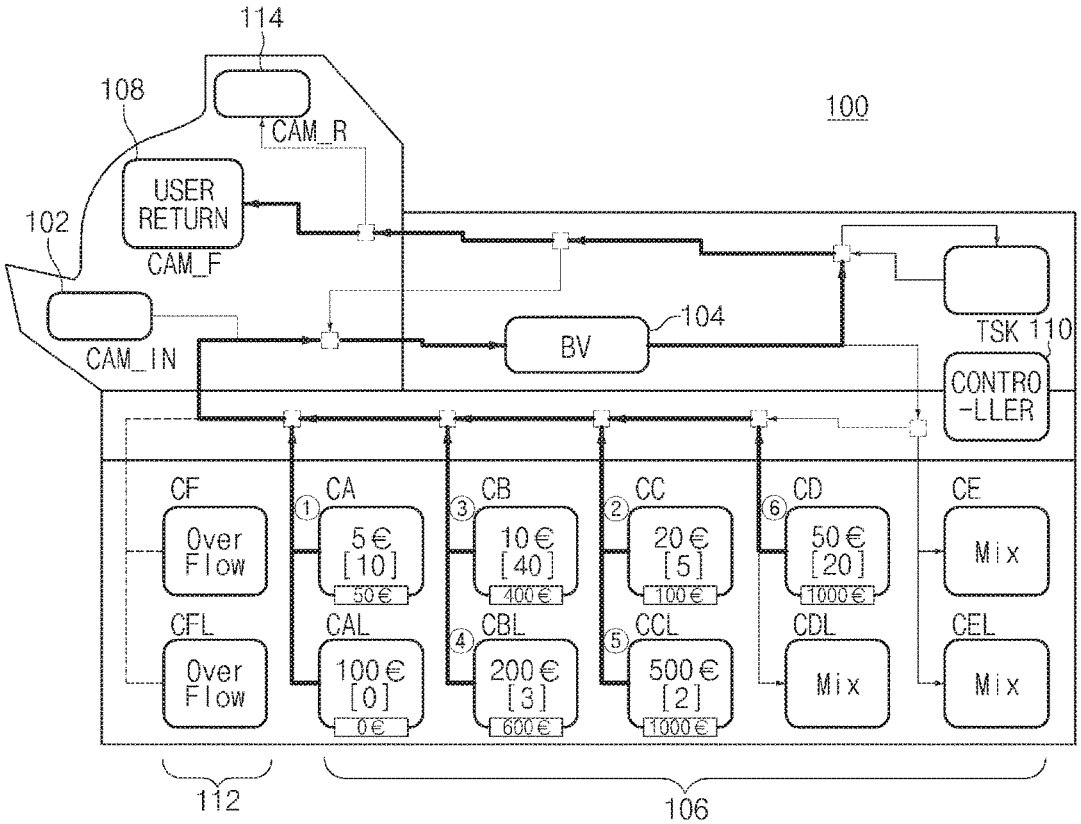
FIG. 9 is a diagram showing an exemplary embodiment in which media are withdrawn in the order of a medium storage box in which the total amount of media stored in the medium storage box is small.

FIG. 9 is a diagram showing an exemplary embodiment in which media are withdrawn in the order of a medium storage box in which the total amount of media stored in the medium storage box is small. Specifically. the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the medium storage box cd, a 100-euro medium is stored in the medium storage box cal, a 200-euro medium is stored in the medium storage box cbl, and a 500-euro medium is stored in the medium storage box ccl. In addition, according to the present exemplary embodiment, 10 sheets of 5 euros, 40 sheets of 10 euros, 5 sheets of 20 euros, 20 sheets of 50 euros, 0 sheets of 100 euros, 3 sheets of 200 euros, and 2 sheets of 500 euros are stored in each of the medium storage boxes. Therefore, the total amount of media is 50 euros for the medium storage box ca, 400 euros for the medium storage box cb, 100 euros for the medium storage box cc, 1000 euros for the medium storage box cd, 600 euros for the medium storage box cbl, and 1000 euros for the medium storage box ccl. Therefore, the return is performed in the order of the smallest total amount, that is, in the order of ① 5 euros, ② 20 euros, ③ 10 euros, ④ 200 euros, ⑤ 500 euros, and ⑥ 50 euros. However, in the case of the medium storage box in which 500 and 50 euros are stored, the stored total amount is equal, and therefore, 500 euros having a shorter transfer distance to the dispending unit 108 are withdrawn first, as described above.

Also, if a larger number of media are withdrawn when the media are withdrawn, the serial numbers of all media deposited-withdrawn by the bundle process are compared to be able to again transfer a medium just next to a medium in which the last deposited medium is discovered to the medium storage boxes for each denomination or the serial numbers of the last 5 to 10 sheets deposited-withdrawn by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 10:
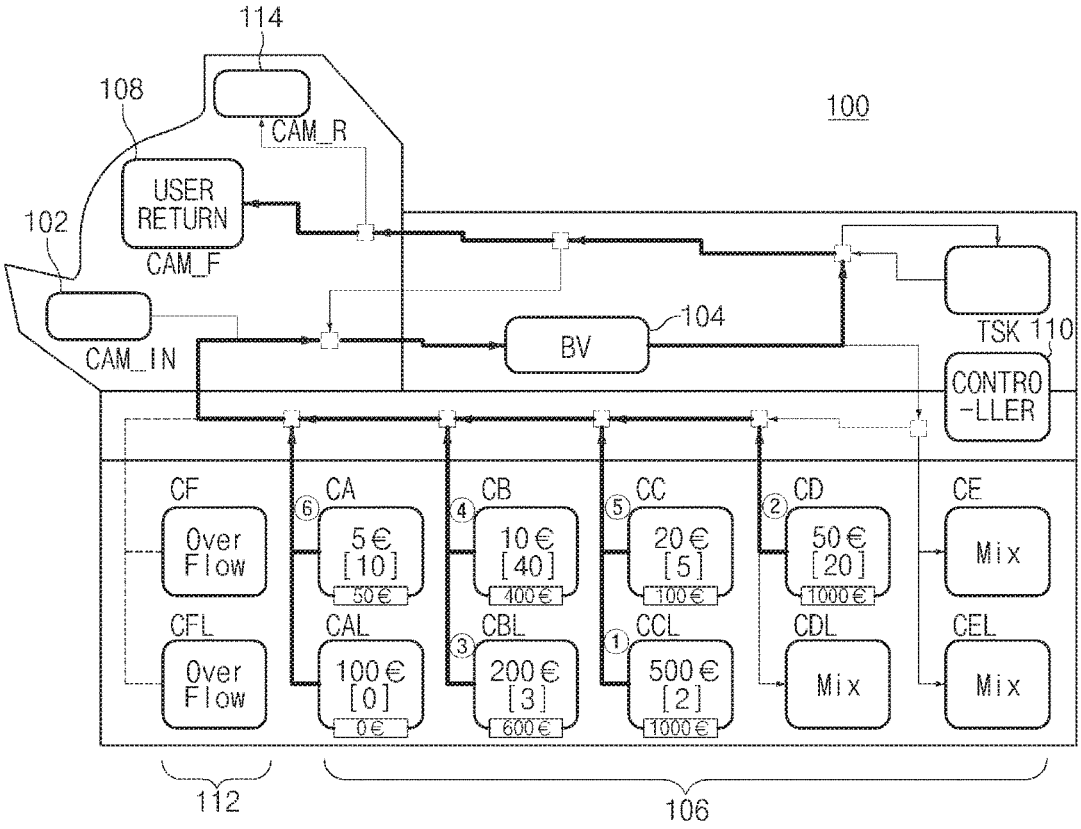
FIG. 10 is a diagram showing an exemplary embodiment in which media are withdrawn in the order of a medium storage box in which the total amount of media stored in the medium storage box is large.

FIG. 10 is a diagram showing an exemplary embodiment in which media return in the order of a medium storage box in which the total amount of media stored in the medium storage box is large. Specifically. the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the media storage box cd, a 100-euro medium is stored in the media storage box cal, a 200-euro medium is stored in the media storage box cbl, and a 500-euro medium is stored in the medium storage box ccl. In addition, according to the present exemplary embodiment, 10 sheets of 5 euros, 40 sheets of 10 euros, 5 sheets of 20 euros, 20 sheets of 50 euros, 0 sheets of 100 euros, 3 sheets of 200 euros, and 2 sheets of 500 euros are stored in each of the medium storage boxes. Therefore, the total amount of media is 50 euros for the medium storage box ca, 400 euros for the medium storage box cb, 100 euros for the medium storage box cc, 1000 euros for the medium storage box cd, 600 euros for the medium storage box cbl, and 1000 euros for the medium storage box ccl. Therefore, the withdrawal is performed in the order of the largest total amount, that is, in the order of ① 500 euros, ② 50 euros, ③ 200 euros, ④ 10 euros, ⑤ 20 euros, and ⑥ 5 euros. However, in the case of the medium storage box in which 500 and 50 euros are stored, the stored total amount is equal, and therefore, 500 euros having a shorter transfer distance to the dispending unit 108 are withdrawn first, as described above.

Also, if a larger number of media are withdrawn when the media are withdrawn, the serial numbers of all media deposited-withdrawn by the bundle process are compared to be able to again transfer a medium just next to a medium in which the last deposited medium is discovered to the medium storage boxes for each denomination or the serial numbers of the last 5 to 10 sheets deposited-withdrawn by the bundle process are compared to be able to again transfer a medium just next to a medium in which the last deposited medium is discovered to the medium storage boxes for each denomination. Further, if the smaller number of media is withdrawn when the media are withdrawn, the serial numbers of all the media or the last 5 to 10 sheets may be compared to perform the additional pickup.

Figure 11:
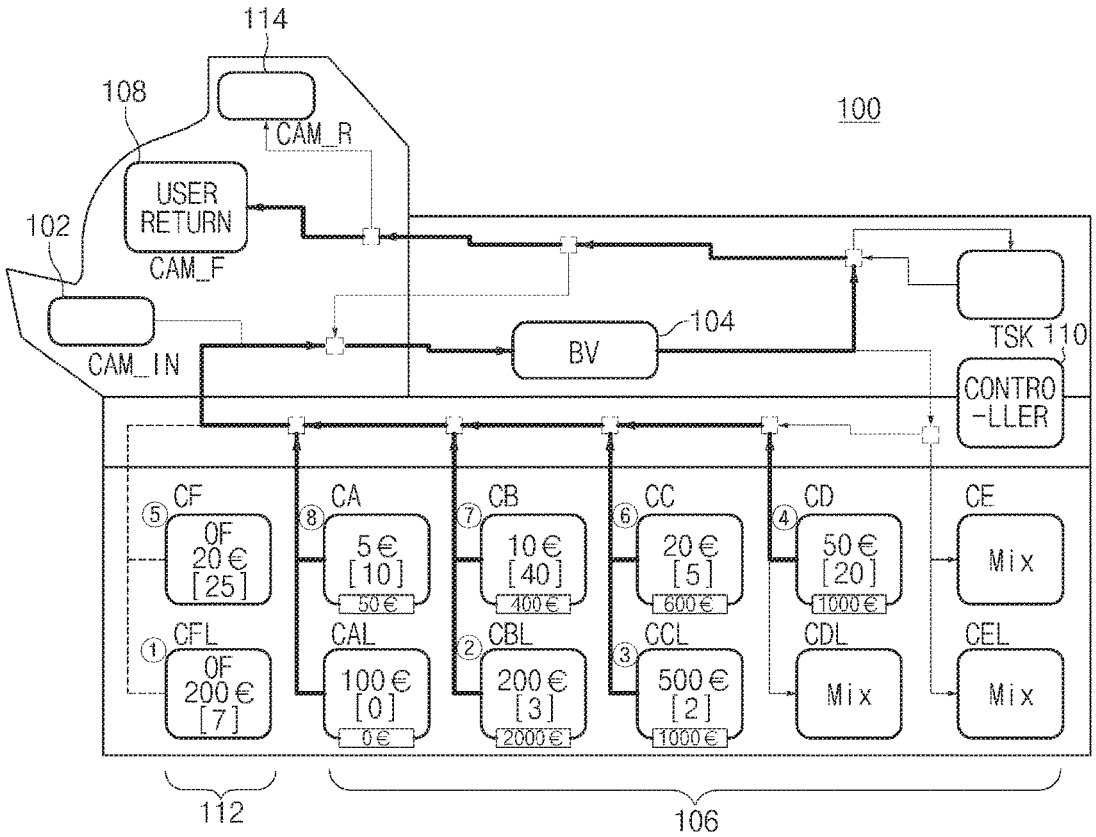
FIG. 11 is a diagram showing an exemplary embodiment in which an operating cassette 112 is additionally used.

FIG. 11 is a diagram showing an exemplary embodiment in which an operating cassette 112 is additionally used. The operating cassette 112 is a cassette that is additionally used for the corresponding denomination when the medium storage unit 106 is in a full state for a certain denomination. The withdrawal order including medium stored in the operating cassette is performed in the order of the largest total amount. Specifically, the medium storage boxes 110 (ca, ca, cb, cc, cd, ce, cal, cbl, ccl, cdl, and cel) for each denomination include a medium storage box ca that stores only 5 euros, a medium storage box cb that stores only 10 euros, a medium storage box cc that stores only 20 euros, a medium storage box cd that stores only 50 euros, a medium storage box cal that stores only 100 euros, a medium storage box cbl that stores only 200 euros, and a medium storage box ccl that stores only 500 euros, and further include a medium storage box cf in which only 20 euros are stored and a medium storage box cfl in which only 200 euros are stored. Therefore, among the media discriminated to be normal by the medium discriminator 104, by discriminating the denomination, a 5-euro medium is stored in the medium storage box ca, a 10-euro medium is stored in the medium storage box cb, a 20-euro medium is stored in the medium storage box cc, a 50-euro medium is stored in the media storage box cd, a 100-euro medium is stored in the media storage box cal, a 200-euro medium is stored in the media storage box cbl, and a 500-euro medium is stored in the medium storage box ccl, and additionally a 20-euro medium is stored in the medium storage box cf and a 200-euro medium is stored in the medium storage box cfl. In the present exemplary embodiment, 10 sheets of 5 euros, 40 sheets of 10 euros, 5 sheets of 20 euros, 20 sheets of 50 euros, 0 sheets of 100 euros, 3 sheets of 200 euros, and 2 sheets of 500 euros are stored in each of the two medium storage boxes 110 and 25 sheets of 20 euros and 7 sheets of 200 euros are each stored in the operating cassette 11. Therefore, the medium storage box ca is for 50 euros, the medium storage box cb is for 400 euros, and a medium for a denomination of 20 euros stored in the medium storage box cc and the medium storage box cf is a total of 600 euros, the medium storage box cd is for 1000 euros, the medium for a denomination of 200 euros stored in the medium storage box cbl and the medium storage box cfl is a total of 2000 euros, and the medium storage box ccl is for 1000 euros. Therefore, the returning is performed in the order of the largest total amount, that is, in the order of ① 200 euros, ② 500 euros, ③ 50 euros, ④ 20 euros, ⑤ 10 euros, and ⑥ 5 euros. However, since there are two medium storage boxes each storing 20 euros and 200 euros including the operating cassette, the medium is first withdrawn from the medium storage box having the short transfer distance as described above.

Also, if a larger number of media are withdrawn when the media are withdrawn, the serial numbers of all media deposited-withdrawn by the bundle process are compared to be able to again transfer a medium just next to a medium in which the last deposited medium is discovered to the medium storage boxes for each denomination or the serial numbers of the last 5 to 10 sheets deposited-withdrawn by the bundle process are compared to be able to again transfer a medium just next to a medium in which the last deposited medium is discovered to the cassettes for each denomination. Further, if the smaller number of media is withdrawn when the media are withdrawn, the serial numbers of all the media or the last 5 to 10 sheets may be compared to perform the additional pickup.

Figure 12:
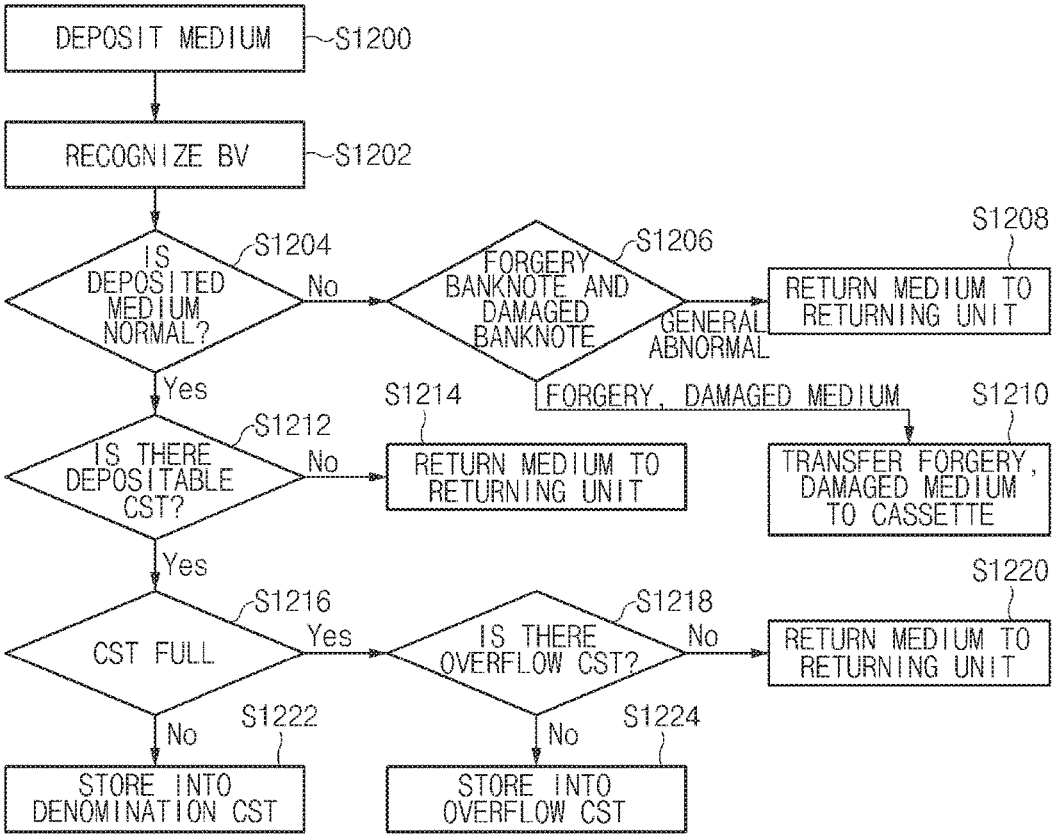
FIG. 12 is a diagram showing a sequence of processing deposited media.

FIG. 12 is a diagram showing a sequence of processing deposited media.

A plurality of media are deposited (S1200), and the denominations of the plurality of deposited media are discriminated (S1204). The medium of which the denomination is discriminated is transferred to the medium storage unit 106 in which the corresponding denomination is stored (S1222). Thereafter, the plurality of media stored in the medium storage unit 106 are transferred to the dispending unit depending on the predetermined criteria as described above.

The medium discriminator 104 may additionally discriminate whether the deposited medium is a normal medium or an abnormal medium (S2104). A step of discriminating the denomination of the corresponding medium if it is discriminated that the medium is the normal medium and again discriminating whether the medium is the general abnormal medium, the forgery medium, the forgeable medium, or the damaged medium if it is discriminated that the medium is the abnormal medium may be additionally performed (S1206). The general abnormal medium returns to the dispending unit (S1208), and the step of transferring the forgery medium, forgeable medium, or the damaged medium to the rejecter 114 may be additionally performed (S1210). In addition, the medium discriminator 104 may additionally perform a step of reading the serial numbers for all the deposited media or the last 5 to 10 sheets of the deposited media. A step of determining whether there is a medium storage box in which the medium discriminated as the normal medium by the media discriminator 104 can be deposited may be additionally performed (S1212). In addition, if there is the medium storage box in which the corresponding medium can be stored, the medium discriminator 104 may additionally perform a step of again determining whether the medium storage boxes for each denomination is in the full state (S1216). If the medium storage boxes for each denomination are not in a full state, the deposit medium is stored in the medium storage boxes for each denomination in which only the denominations of the corresponding medium are stored (S1222). Here, for example, the determination on whether the medium storage box is in the full state may be made by a full sensing sensor, or the like. If the medium storage boxes for each denomination is in the full state, a step of determining whether there is the operating cassette that is not used or in which the medium for the denomination of the corresponding medium is stored may be additionally performed (S1218). Here, if there are a plurality of medium storage boxes under the same conditions in which the media having the same denomination may be stored, the medium may be stored in the order of the closest medium storage boxes, stored in the order of the fewest remaining sheets, or stored according to the type of medium storage boxes. If there is the operating cassette in which the deposit medium may be stored, the deposit medium may be stored in the operating cassette (S1224), and if there is no operating cassette in which the deposit medium may be stored, a step of withdrawing the medium to the dispending unit may be additionally performed (S1220). In this way, the medium stored in the medium storage boxes for each denomination or the operating cassette returns by denomination according to the predetermined criteria, as described above.

According to the exemplary embodiment of the present disclosure, the denomination bundle process may provide a user with coefficients of various options. This can greatly reduce time for a user to access the media deposit/withdrawal module, and automatically can classify a medium by denomination and provide the classified medium to effectively improve a user task. That is, when a user wants to separate a large amount of randomly mixed media by country, denomination and amount and store the media in a safe, the related art can process the media quickly but has an inconvenience that the user has to again separate the media one by one. However, as described above, according to the exemplary embodiment of the present disclosure, the plurality of deposited media are separated and withdrawn by denomination according to the predetermined criteria automatically set, thereby greatly reducing the actual working time and reducing the user's workload. In addition, the exemplary embodiment of the present disclosure can be applied not only to denominations, but also to the work of separating media from various countries, which will provide an effective value in the related business (European Union, major tourist destinations, currency exchange, etc.).

A financial device according to an exemplary embodiment of the present disclosure is a device which receives various media such as a banknote, securities, a giro, a coin, and a gift certificate to execute medium processing such as processings like deposit processing, giro receipt, and gift certificate exchange, etc., and/or processings like withdrawal processing, a giro release, a gift certificate release, etc., to thereby execute financial businesses. An example of the financial device may include an automatic teller machine (ATM) such as a cash dispenser (CD) and a cash recycling device. However, the financial device is not limited to the foregoing example, and therefore may be an apparatus for automating financial businesses like a financial information system (FIS).

As another exemplary embodiment of the present disclosure, the rollback function can be implemented by using the processing method described above upon the deposit cancellation. Specifically, another exemplary embodiment of the present disclosure includes returning the medium of the same serial number as the deposited medium in the state in which a staff member deposits a small amount/large amount of medium in the medium deposit/dispending unit.

As described above, since the apparatus for processing a medium of the present disclosure records the serial numbers for all the deposited media along with the deposited order, the apparatus for processing a medium of the present disclosure can inquire or analyze the serial numbers.

Therefore, the medium of the same serial number is recognized, and thus may forcibly return as it is upon the deposit cancellation even when it is discriminated as a non-recognition/defect medium. Also, if the serial number is not recognized, the serial numbers of 1 to 3 sheets of media before and after the corresponding medium are compared and if it is determined that the serial numbers are the same as the deposited medium, the unrecognized medium is also forcibly withdrawn. In addition, when the deposited medium is mixed in the apparatus for processing a medium or even when the deposited medium is not the medium deposited by the user, the corresponding medium is rejected to withdraw the media having the same serial number as the serial number of the deposited media, That is, when the large-capacity medium deposit transaction is being performed rather than the small-capacity medium deposit, if the withdrawal needs to be performed without the approval of deposit, the medium having the same serial number as the deposited medium is withdrawn as it is by using the above-described method.

Meanwhile, according to another exemplary embodiment of the present disclosure, a currency exchange function may be additionally implemented in addition to the general deposit and withdrawal function by using the processing function described above.

Specifically, like storing the deposited medium by the cassette depending on the units of the above-mentioned medium, for the currency exchange target medium in the currency exchange system, the minimum unit medium and the main use medium are set to be stored in the reflux cassette.

When the user intends to exchange the medium, the user selects an exchange target medium and deposits the selected medium that should be exchanged in the apparatus for processing a medium. Among the deposited media, a reject medium, a forgery medium, or a damaged medium returns and only the normal medium is exchanged. An exchange transaction is classified into a general exchange transaction primarily receiving deposit as TSK (temporary stacking unit) and a bulk exchange transaction using a reflux cassette, depending on the amount of deposited medium.

While a TSK is used for general exchange transaction due to its small capacity, the deposit cassette is used for large-capacity medium exchange transaction such as other embodiments.

In addition, serial numbers of all media deposited are recorded. When the user wishes to exchange money, an exchange rate is specified, a medium of the converted amount is withdrawn, but a balance under a medium of a minimum unit is deposited into the user's account. Alternatively, the user can withdraw the balance at the counter.

Further, in the exchange transaction, when the deposit cassette is full, an overflow cassette may be used. In this case, since the sizes of the media by country are different, the media may be separated into and stored in two cassettes according to the sizes.

In addition, since the balance between the number of minimum unit mediums and the number of main use media is important at the time of the exchange withdrawal, the number to be withdrawn is adjusted by denomination so that the difference in the number of media is not excessively large. For example, it is set that there is not large difference between the number of minimum unit mediums and the number of main use media. Basic steps in this embodiment are substantially same with that of counting media for each denomination.

Meanwhile, all the components configuring the exemplary embodiment of the present disclosure are described as coupled in one or operated, being coupled with each other, but the present disclosure is not necessarily limited to the exemplary embodiments. That is, all the components may be operated, being optionally coupled with one or more within the scope of the present disclosure. Further, all the components may be each implemented in one independent hardware, but a part or all of each component may be selectively combined to be implemented as a computer program having a program module performing some functions or all the functions combined in one or a plurality of hardwares. Codes and code segments configuring the computer program may be easily inferred by those skilled in the art to which the present disclosure pertains. The computer program is stored in computer readable media and is read and executed by a computer, thereby making it possible to implement the exemplary embodiment of the present disclosure. An example of the storage media of the computer program may include a magnetic recording medium, an optical recording medium, a carrier wave medium, and the like.

In addition, hereinabove, the terms "include", "configure", "have", or the like, are to be interpreted to imply the inclusion of other components rather than the exclusion of other components, since they mean that a corresponding component may be included unless particularly described otherwise. It is to be understood that all the terms including technical and scientific terms has the same meaning as those that are understood by those who skilled in the art, unless particularly described to the contrary. Generally used terms such as terms defined in a dictionary should be interpreted as the same meanings as meanings within a context of the related art and should not be interpreted as ideally or excessively formal meanings unless clearly defined in the present specification.

As described above, according to the exemplary embodiments of the present disclosure, the plurality of deposited media are automatically separated and return by denomination according to predetermined criteria, thereby greatly reducing the actual working time and reducing the workload of the user.

The spirit of the present disclosure has been just exemplified. It will be appreciated by those skilled in the art that various modifications and alterations can be made without departing from the essential characteristics of the present disclosure. Accordingly, the exemplary embodiments disclosed in the present disclosure and the accompanying drawings are used not to limit but to describe the spirit of the present disclosure. The scope of the present disclosure is not limited only to the exemplary embodiments and the accompanying drawings. The scope of the present disclosure should be interpreted by the following claims and it should be interpreted that all spirits equivalent to the following claims fall within the scope of the present disclosure.

What is claimed is:

1. An apparatus for processing a medium, comprising:

an accepting unit in which the medium is put by a user, deposited outside of the apparatus for processing a medium;

a dispensing unit from which the medium is withdrawn;

a medium discriminator that discriminates a denomination of the medium put into the accepting unit;

a plurality of medium storage boxes each that discriminates and stores the medium by denomination of the medium discriminated by the medium discriminator; and a controller that stores the medium put through the accepting unit by the same denomination in the medium storage box and withdraws the put medium from the medium storage box according to a predetermined withdrawal criterion, wherein, when the controller withdraws the put medium for counting the put medium, the controller withdraws the put medium by comparing serial number of the put medium and serial number of withdrawn medium while withdrawing the put medium from the medium storage box according to a predetermined withdrawal criterion.

2. The apparatus according to claim 1, wherein the medium discriminator discriminates whether the medium is abnormal or normal.

3. The apparatus according to claim 2, wherein it is again discriminated whether the medium discriminated to be abnormal by the medium discriminator is a general abnormal medium, a forgery medium, a forgeable medium, or a damaged medium, and the medium discriminated as the general abnormal medium is transferred to the dispensing unit.

4. The apparatus according to claim 3, wherein the medium discriminated as the forgery medium, the forgeable medium, or the damaged medium by the medium discriminator is transferred to a separate medium storage box.

5. The apparatus according to claim 1, wherein when the put medium is stored in the medium storage box, if the medium storage box storing the same denomination is plural, the put medium is stored in the medium storage box in the order of the medium storage box having a short transfer distance.

6. The apparatus according to claim 1, further comprising:

a storage unit in which information on the predetermined withdrawal criterion is stored, wherein a medium is withdrawn to the dispensing unit in the order of a medium having a smallest number of denominations according to the predetermined withdrawal criterion.

7. The apparatus according to claim 1, further comprising:

a storage unit in which information on the predetermined withdrawal criterion is stored, wherein a medium is withdrawn to the dispensing unit in the order of a medium having a smallest total amount of denominations according to the predetermined withdrawal criterion.

8. The apparatus according to claim 1, further comprising:

a storage unit in which information on the predetermined withdrawal criterion is stored, wherein a medium is withdrawn to the dispensing unit in the order of a medium having a largest total amount of denominations according to the predetermined withdrawal criterion.

9. The apparatus according to claim 1, further comprising:

a storage unit in which information on the predetermined withdrawal criterion is stored, wherein the predetermined withdrawal criterion is withdrawn to the dispensing unit in the order of a medium having a largest denomination amount.

10. The apparatus according to claim 1, further comprising:

a storage unit in which information on the predetermined withdrawal criterion is stored, wherein the predetermined withdrawal criterion is withdrawn to the dispensing unit in the order of a medium having a low denomination amount.

11. The apparatus according to any one of claims 6 to 10, wherein in determining the order, in case of the medium for same withdrawal criterion, the medium stored in the medium storage box having a short transfer distance to the dispensing unit is first withdrawn.

12. A method for processing a medium, comprising:

discriminating denominations of a plurality of deposited media;

transferring the medium of which the denomination is discriminated to a medium storage box in which the same denomination is stored among a plurality of medium storage units; and withdrawing the medium stored in the medium storage box to a dispensing unit according to a predetermined withdrawal criterion, wherein, when withdrawing the medium for counting the medium, the medium are withdrawn by comparing serial number of the medium and serial number of withdrawn medium while withdrawing the medium from the medium storage box according to a predetermined withdrawal criterion.

13. The method according to claim 12, wherein the discriminating of the denomination of the medium includes:

discriminating whether the plurality of media are abnormal or normal; and if it is discriminated that the medium is abnormal, again discriminating whether the medium is a general abnormal medium, a forgery medium, a forgeable medium, or a damaged medium.

14. The method according to claim 13, wherein the medium discriminated as the general abnormal medium among the media is transferred to the dispensing unit, and the medium discriminated as the forgery medium, the forgeable medium, or the damaged medium among the media is transferred to a separate medium storage box.

15. The method according to claim 13, wherein the medium discriminated as the normal medium among the media is transferred to the medium storage box by the discrimination of the denomination.

16. The method according to claim 12, wherein a medium is withdrawn to the dispensing unit in the order of a medium having a smallest number of denominations according to the predetermined withdrawal criterion.

17. The method according to claim 12, wherein the predetermined withdrawal criterion is withdrawn to the dispensing unit in the order of a medium having a smallest total amount of denominations.

18. The method according to claim 12, wherein a medium is withdrawn to the dispensing unit in the order of a medium having a largest total amount of denominations according to the predetermined withdrawal criterion.

19. The method according to claim 12, wherein a medium is withdrawn to the dispensing unit in the order of a medium having a largest denomination amount according to the predetermined withdrawal criterion.

20. The method according to claim 12, wherein a medium is withdrawn to the dispensing unit in the order of a medium having a smallest denomination amount according to the predetermined withdrawal criterion.

21. The method according to claim 12, wherein the medium having same serial number with serial number of the medium put according to a predetermined withdrawal criterion can be withdrawn.

22. The method according to claim 12,

Wherein the medium can be withdrawn for exchange transaction, the medium withdrawn is adjusted so that there is not a more than three times the difference between the number of minimum unit mediums and the number of main use media.

* * * * *